US006073521A

United States Patent [19]

Uno et al.

[11] Patent Number: 6,073,521

[45] Date of Patent: Jun. 13, 2000

[54] PNEUMATICALLY OPERABLE SCREW DRIVER

[75] Inventors: Akira Uno, Hitachioota; Michio Wakabayashi, Hitachinaka; Yasuki Ohmori, Hitachinaka; Yasuo Sasaki, Hitachinaka, all of Japan

[73] Assignee: Hitachi Koki Co., Ltd., Tokyo, Japan

[21] Appl. No.: 09/267,609

[22] Filed: Mar. 15, 1999

[30] Foreign Application Priority Data

Apr. 22, 1998 [JP] Japan ..... 10-111845

[51] Int. Cl.[7] ..... B25B 23/04

[52] U.S. Cl. ..... 81/57.44; 81/431; 81/433; 227/8

[58] Field of Search ..... 81/57.44, 57.37, 81/431, 433–435; 227/8; 173/2, 4, 10, 11

[56] References Cited

U.S. PATENT DOCUMENTS 5,231,902 8/1993 Uno et al. ..... 81/57.44
5,495,973 3/1996 Ishizawa et al. ..... 227/8
5,730,035 3/1998 Ohmori et al. ..... 81/57.44
5,862,724 1/1999 Arata et al. ..... 81/434

FOREIGN PATENT DOCUMENTS 58-50833 11/1983 Japan .
64-45579 2/1989 Japan .
5-261676 10/1993 Japan .

OTHER PUBLICATIONS

An Edition For "Pneumatically–Operated Nail Drivers" By Hitachi Koki Co., Ltd.,; Sep. 1991; pp., 29–36.

*Primary Examiner*—James G. Smith
*Assistant Examiner*—Lee Wilson
*Attorney, Agent, or Firm*—Louis Woo

[57] ABSTRACT

A main valve and a manual operating valve cooperatively control the compressed air supplied to an air motor and a piston. The main valve is responsive to the compressed air supplied from the manual operating valve via an air passage. An orifice is provided in the air passage to reduce the speed of the compressed air supplied to the main valve so that the shift movement of the main valve is delayed when the manual operating valve is closed.

3 Claims, 7 Drawing Sheets

PNEUMATICALLY OPERABLE SCREW DRIVER

BACKGROUND OF THE INVENTION

The present invention relates to a pneumatically operable screw driver preferably used for fixing a threaded fastening member to a wood material or the like.

Various pneumatically operable screw drivers have been conventionally proposed. According to a typical arrangement of the pneumatically operable screw drivers, a piston pushes a driver bit while an air motor rotates this driver bit. Thus, a threaded fastening member driven by the driver bit can rotate and protrude forward. For example, the Japanese Patent Application Kokai No. Hei 1-45579 discloses a screw driver which has a driver bit moving downward together with an air motor. The Japanese Patent Application Kokai No. Hei 5-261676, corresponding to the U.S. Pat. No 5,231,902 (DEP 4219032), discloses another screw driver which has a driver bit moving downward and a stationary air motor not moving downward together with the driver bit.

In general, the screw drivers take a relatively long time for driving and fixing a threaded fastening member due to their unique driving mechanism causing the driver bit to rotate and protrude simultaneously. An average time required in the practical screw fastening operations is approximately 0.1 to 0.2 sec which is more than 20 times the corresponding fastening time (approximately 0.005 sec) of the nail (i.e., non-threaded fastener) drivers.

Accordingly, in the actual operations of the screw drivers, operators are usually forced to hold a push lever linked to a manual operating valve of the screw driver for a while until the screw fastening operation is completely finished. The holding time, i.e., a waiting time, inherent to the screw drivers may be too much long for the operators who frequently use the nail drivers or other speedily performable pneumatic tools.

When the operator releases the finger force acting on the push lever at an early timing before finishing the screw fastening operation, the manual operating valve returns to the close position to stop the compressed air. The air motor and the piston cannot drive the driver bit any more at this moment. Thus, the driving operation of the screw is interrupted incompletely.

SUMMARY OF THE INVENTION

An object of the present invention is to provide a pneumatically operable screw driver reliable in operation.

In order to accomplish this and other related objects, the present invention provides a pneumatically operable screw driver comprising an air motor in which a rotor is rotatable in response to the pressure of compressed air, a piston rotated by the air motor and driven in an axial direction by the pressure of the compressed air, a driver bit attached to a front end of the piston, a manual operating valve having an open position for supplying the compressed air to the air motor and the piston, a main valve responsive to the closing of the manual operating valve to stop the compressed air supplied to the piston, and a delay mechanism for delaying a shift movement of the main valve when the manual operating valve is closed.

Preferably, an air passage is provided between the manual operating valve and the main valve, and the delay mechanism is for reducing the flow speed of the compressed air supplied to the main valve via the air passage.

According to a preferred embodiment of the present invention, the delay mechanism is an orifice provided in the air passage.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENT

Figure 1:
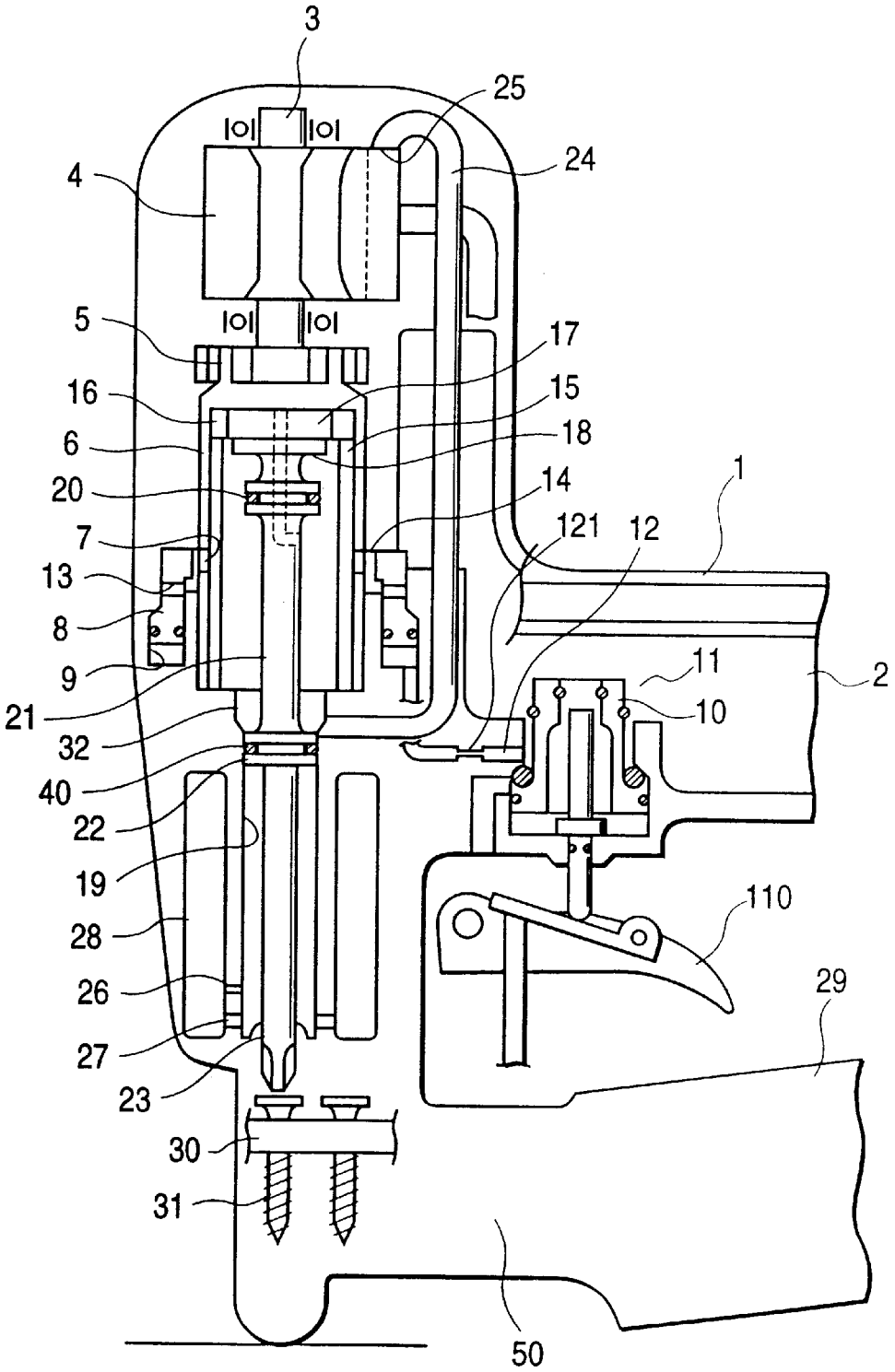
FIG. 1 is a schematic view showing an initial condition of a pneumatically operable screw driver in accordance with a preferred embodiment of the present invention.

A preferred embodiment of the present invention will be explained with reference to the attached drawings. Identical parts are denoted by the same reference numerals throughout the views. The directions used in the following explanation are defined based on a screw driver held in a vertical position with a driver bit extending downward and a grip extending in a horizontal direction. Needless to say, the actual direction of the screw driver will be frequently changed due to its handiness when it is used.

FIGS. 1 to 7 show a preferable embodiment of a pneumatically operable screw driver in accordance with the present invention. A frame body 1 forms an outer casing of the pneumatically operable screw driver. The frame body 1 has an inside space defining an accumulator chamber 2 extending from a grip to an upper body of the pneumatically operable screw driver. The accumulator chamber 2 has an intake port (not shown) at the rear end thereof for introducing the compressed air.

An air motor 4 is provided at the upper portion in the frame body 1. The air motor 4 has a rotor 3 rotatable about its axis when it receives the compressed air. The rotor 3 engages with a planetary gear unit 5 to transmit the speed-reduced rotation to a rotary member 6. The rotary member 6 causes a speed-reduced rotation in synchronism with the rotation of the rotor 3. The rotary member 6 is a cylinder with a bottom. The rotary member 6 is rotatably supported via a needle bearing (not shown) by a cylindrical inside wall of the frame body 1 extending in the up-and-down direction.

The rotary member 6 has air holes 7 provided at the axial central thereof. A cylindrical main valve 8, disposed outside the rotary member 6, faces the air holes 7. The main valve 8 is shiftable along a slide groove 9 in the up-and-down direction and is resiliently urged upward by a spring (not shown). An air passage 12 extends from the slide groove 9 to a manual operating valve 11 via a valve piston 10.

An orifice 121, having a reduced cross section, is provided in the air passage 12. The orifice 121 increases the flow resistance of the air passage 12. Thus, the compressed air flowing in the air passage 12 is substantially reduced by the orifice 121.

The main valve 8 is sealed at the upper and lower side walls thereof. An air hole 13 is provided at an axial center of the main valve 8. Another air hole 14, provided at the upper portion of the slide groove 9, communicates with the accumulation chamber 2.

The rotary member 6 has an inside wall on which at least a pair of elongated recesses 15 are formed. Each elongated recess 15 extends in the axial direction (i.e., up-and-down direction) to serve as part of a rotational force transmitting mechanism.

A rotary slider 17 is slidably coupled with a cylindrical inside wall of the rotary member 6. The rotary slider 17 has at least a pair of protrusions 16 engaging with the recesses 15 of the rotary member 6. Being guided by the serrated engagement between the recesses 15 and the protrusions 16, the rotary slider 17 is slidable in the axial direction without causing a relative rotation with respect to the rotary member 6.

The rotary slider 17 has an air shut face 18. An O-ring 20 is equipped on the outer cylindrical surface of the rotary slider 17. A shaft 21 has an upper end fixed to the rotary slider 17 by means of screws or equivalents. The shaft 21 has an enlarged lower portion having an inside space serving as a driver bit holder for securely holding a driver bit 23. The lowermost end of the enlarged lower portion of the shaft 21 serves as a piston 22. A seal ring 40 is provided on an outer cylindrical surface of the piston 22. With this seal ring 40, the piston 22 is hermetically coupled with the inside wall of a cylinder 19. The piston 22 is slidable in the axial (i.e., up-and-down) direction along the inside wall of the cylinder 19.

A damper plate (not shown), positioned above the cylinder 19, is brought into contact with the air shut face 18 of the rotary slider 17 when the rotary slider 17 reaches the dead end of its lowering stroke. An air hole 32 opens at a portion under the damper plate. The air hole 32 communicates with an air intake port 25 of the air motor 4 via an air passage 24.

Two air holes 26 and 27 open to the lower portion of the cylinder 19. A space between the cylinder 19 and the lower portion of the frame body 1 serves as a returning accumulator chamber 28 whose arrangement is well known in the conventional pneumatically operable nail drivers.

A screw feeder 50, although its detailed structure is not shown in the drawing, is positioned at the lower end of the frame body 1. The screw feeder 50 is associated with a magazine 29 that accommodates a bundle of screws 31 assembled by a connecting band 30. The screw feeder 50 successively feeds the screws 31 from the magazine 29 to a predetermined position under the driver bit 23. A push lever 110, provided above the screw feeder 50, is linked with the manual operating valve 11.

The above-described screw driver operates in the following manner.

First, the compressed air is introduced into the accumulator chamber 2 when the accumulator chamber 2 is connected to a compressor (not shown). As is well known in the conventional pneumatically operable nail drivers, the valve piston 10 lifts upward in response to the pressure of the introduced air. Part of the compressed air flows from the accumulator chamber 2 to the lower portion of the slide groove 9 of the main valve 8 via the air passage 12. Thus, the lower surface of the main valve 8 receives the pressure of the compressed air. The main valve 8 shifts upward. When the main valve 8 reaches the uppermost position, the upper end of the main valve 8 is sealed. The air holes 7 are closed by the main valve 8 so as to isolate the inside space of the rotary member 6 from the accumulator chamber 2. In this condition, no compressed air is supplied to the air motor 4 and the piston 22.

Hereinafter, the screw driving operation of the screw driver is explained with reference to FIGS. 2 to 7. In the drawings, a portion filled with the compressed air is indicated by a dot hatching and the flow direction of the compressed air is indicated by bold arrows.

A first stage of the screw driving operation includes the steps of: opening the manual operating valve 11; opening the main valve 8; and supplying the compressed air to the upper portion of the piston 22 and the air passage 24.

Figure 2:
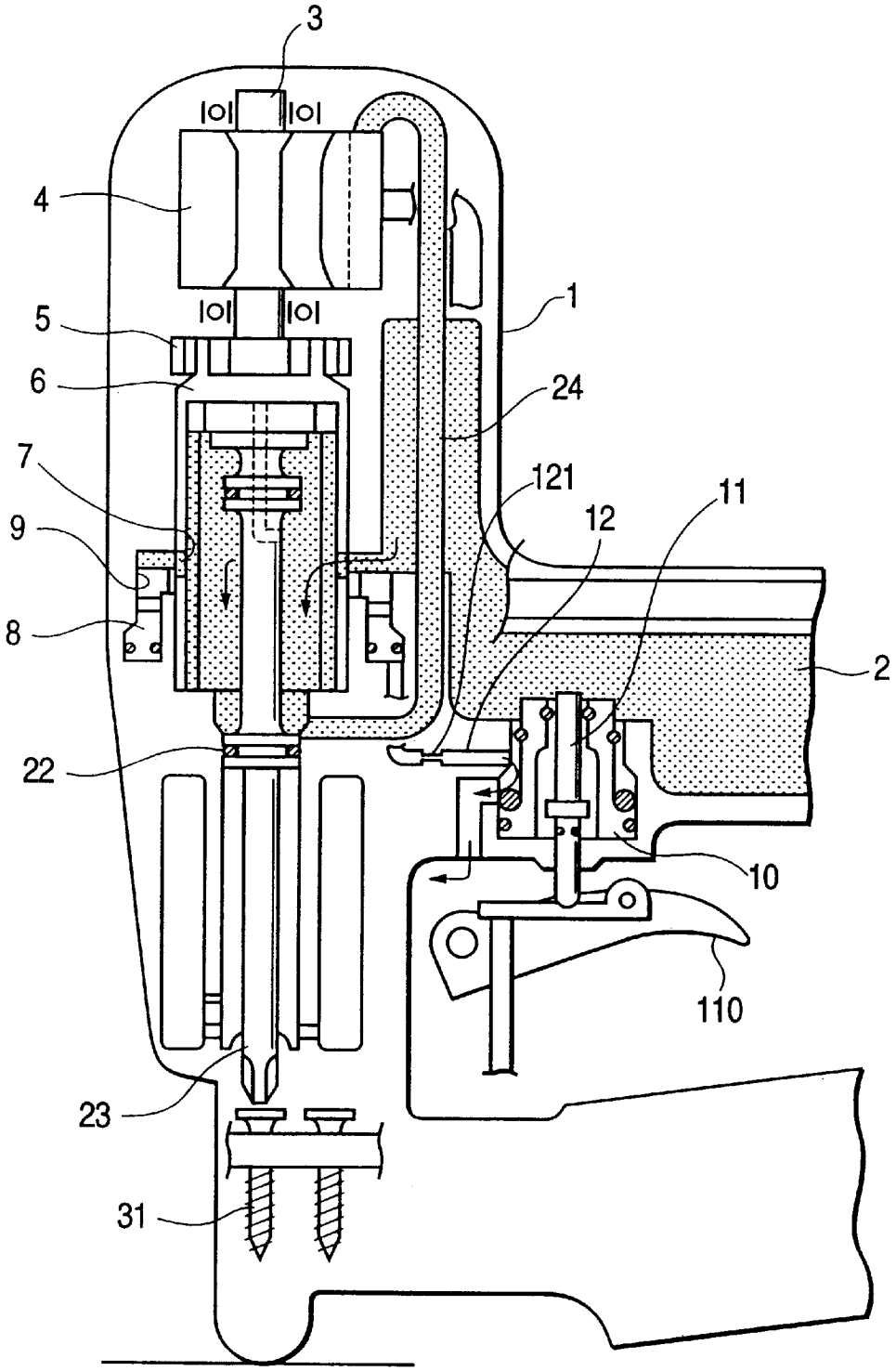
FIG. 2 is a schematic view showing a valve opening condition of a manual operating valve in the pneumatically operable screw driver shown in FIG. 1.

As shown in FIG. 2, when the manual operating valve 11 is lifted upward by pulling the push lever 110, the valve piston 10 shifts downward in the manner well known by the operating valves of the nail drivers. The air passage 12 opens to the atmosphere. The compressed air is thus discharged from the lower portion of the slide groove 9 to the atmosphere as indicated by the arrows. The main valve 8 shifts downward. The air holes 7 of the rotary member 6 are opened. The compressed air of the accumulator chamber 2 is then directly introduced into the upper space of the piston 22 and the air passage 24 as indicated by the arrows.

A second stage of the screw driving operation includes the steps of: lowering the piston 22 while rotating the air motor 4; engaging the front end of the driver bit 23 with the cross groove formed on the head of the screw 31 and rotating the rotary member 6; and rotating the driver bit 23.

Figure 3:
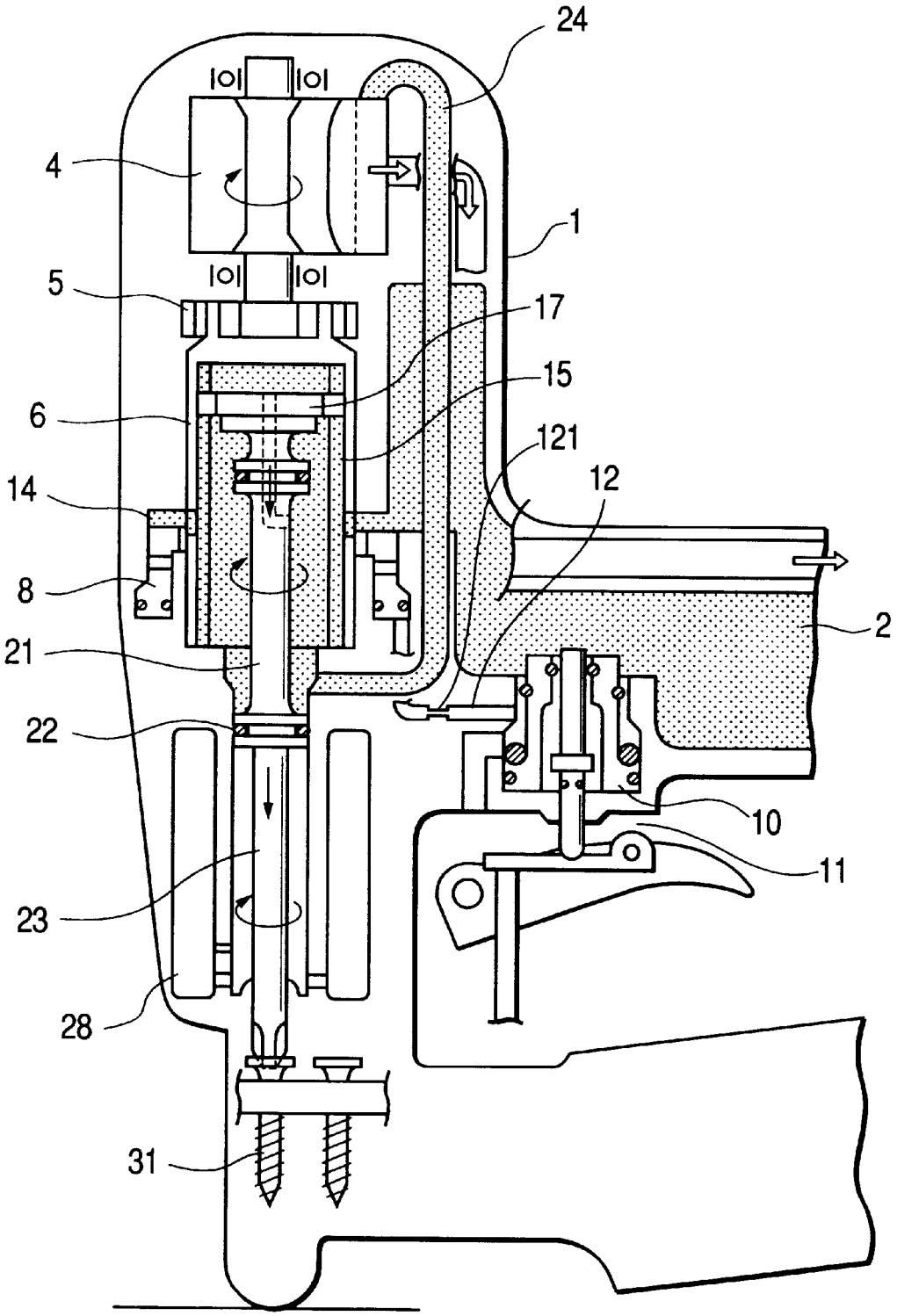
FIG. 3 is a schematic view showing a driver bit which starts rotating and protruding from the condition shown in FIG. 2.

As shown in FIG. 3, when the compressed air is introduced into the rotary member 6, the upper surface of the piston 22 receives the pressure of the introduced air. Thus, the piston 22 starts shifting downward. At the same time, the compressed air is supplied to the air motor 4 via the air passage 24. The air motor 4 starts rotating. When the piston 22 shifts a predetermined distance, the front end of the driver bit 23 reaches the screw 31 and engages with the cross groove formed on the head of the screw 31. Meanwhile, the rotation of the air motor 4 is transmitted to the rotary member 6 via the planetary gear unit 5. As the recesses 15 and the protrusions 16 form the serrated engagement serving as the rotational force transmitting mechanism, the rotary slider 17 rotates together with the rotary member 6. The piston 22 and the driver bit 23 also rotate integrally with the rotary slider 17.

A third stage of the screw driving operation includes the step of causing the driver bit 23 to start driving the screw 31.

Figure 4:
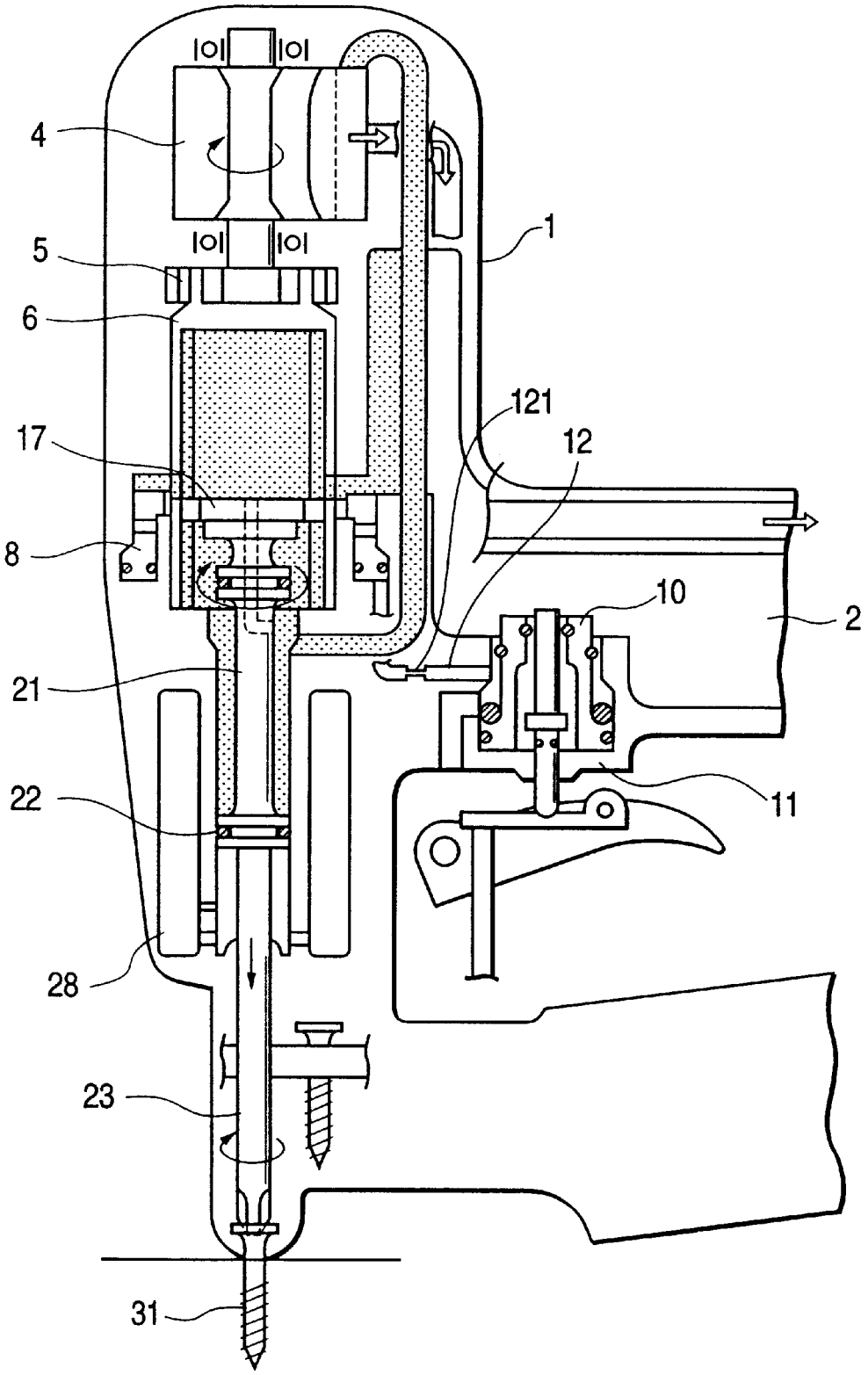
FIG. 4 is a schematic view showing a screw driving operation continuing from the condition shown in FIG. 3.

As shown in FIG. 4, the rotational and pushing force of the piston 22 is transmitted to the driver bit 23. Thus, the screw 31, engaged with the driver bit 23, is driven into a wood material or the like.

A fourth stage of the screw driving operation includes the steps of: causing the air shut face 18 to close the air passage 24 at the bottom dead center of the piston 22; stopping the air motor 4; and supplying the compressed air into the returning accumulator chamber 28.

Figure 5:
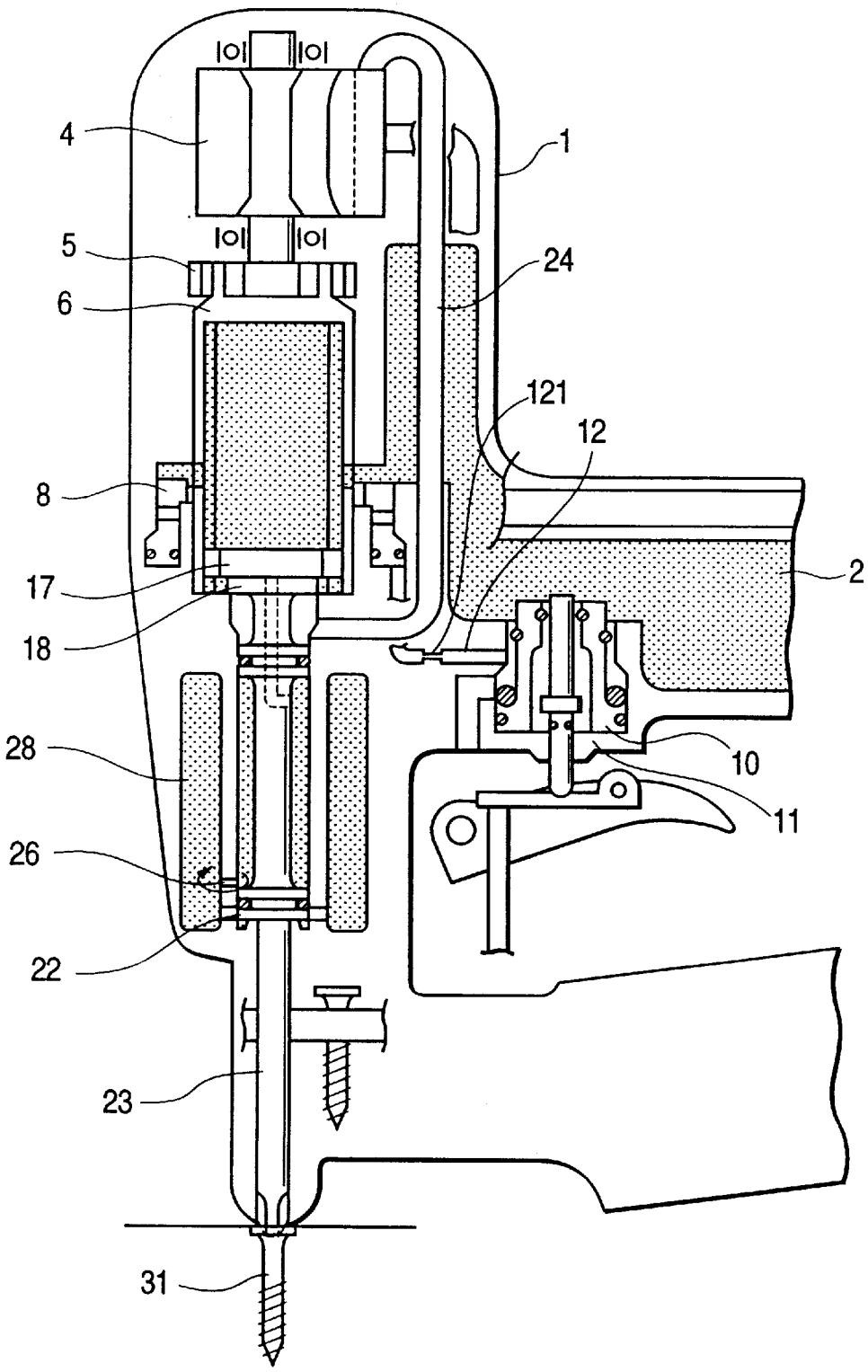
FIG. 5 is a schematic view showing a completed condition of the screw driving operation.

As shown in FIG. 5, when the screw 31 is fastened until its head becomes flush with the surface of the wood material or the like, the piston 22 reaches the bottom dead center. At the same time, the air shut face 18 closes the air passage 24 so that no compressed air is supplied to the air passage 24. Accordingly, the air motor 4 stops rotating. Meanwhile, when the piston 22 is positioned at the bottom dead center, the compressed air is supplied to the returning accumulator chamber 28 via the air hole 26.

A fifth stage of the screw driving operation includes the steps of: closing the manual operating valve 11; closing the main valve 8; and discharging the compressed air from the upper space of the piston 22.

Figure 6:
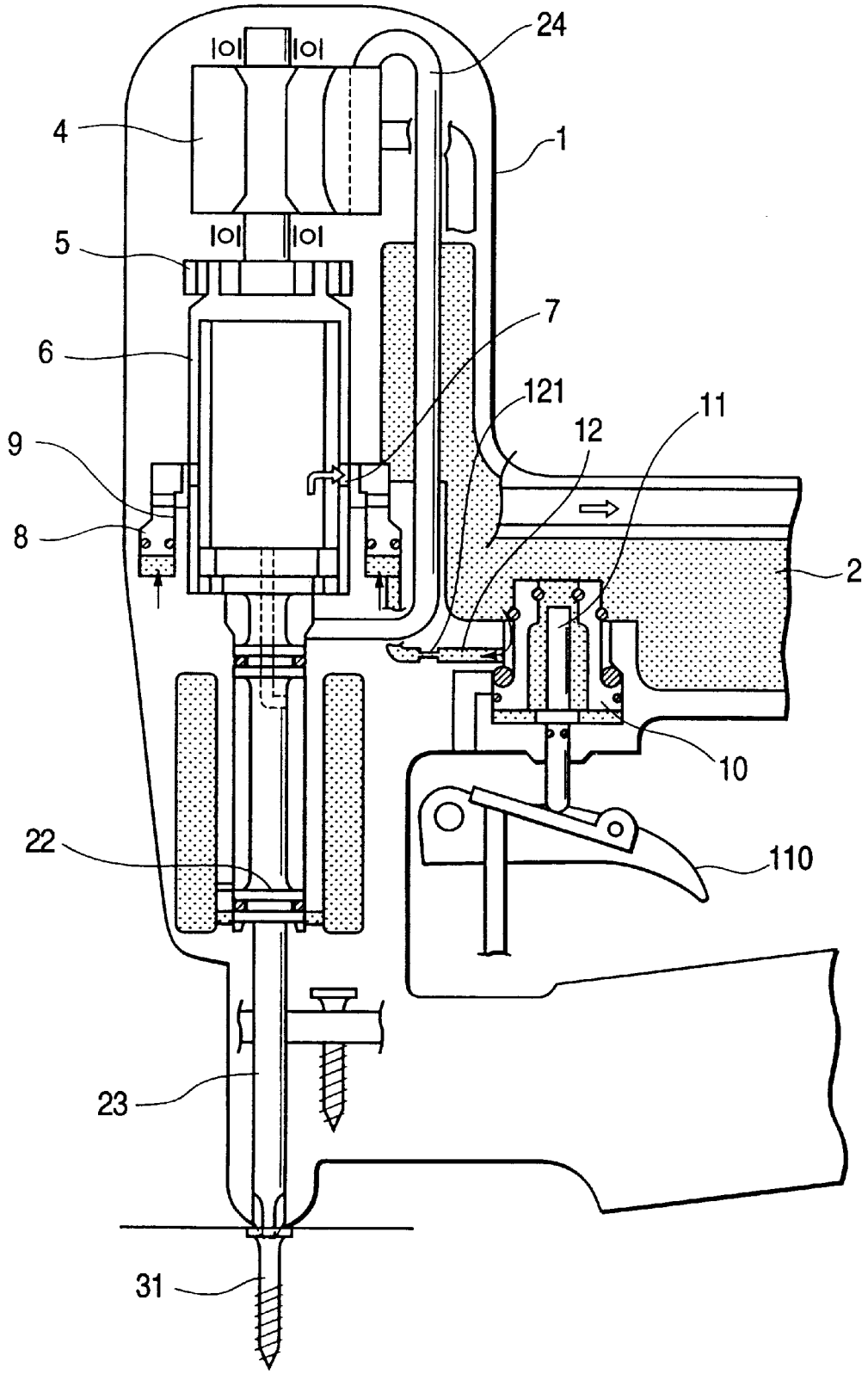
FIG. 6 is a schematic view showing a released condition of the manual operating valve after completing the screw driving operation shown in FIG. 5.

As shown in FIG. 6, when the push lever 110 of the manual operating valve 11 is released, the valve piston 10 lifts upward. The compressed air is supplied from the accumulator chamber 2 to the lower portion of the slide groove 9 via the air passage 12. The main valve 8 shifts upward, and the upper surface of the main valve 8 is sealed. Thus, the air holes 7 are closed so as to isolate the inside space of the rotary member 6 from the accumulator chamber 2. At the same time, the compressed air is discharged from the upper space of the piston 22 vi the air holes 14 and 13 of the main valve 8 and the air passage (not shown).

A sixth stage of the screw driving operation includes the steps of: returning the piston 22 and the driver bit 23 to the original positions; and feeding the next screw 31.

Figure 7:
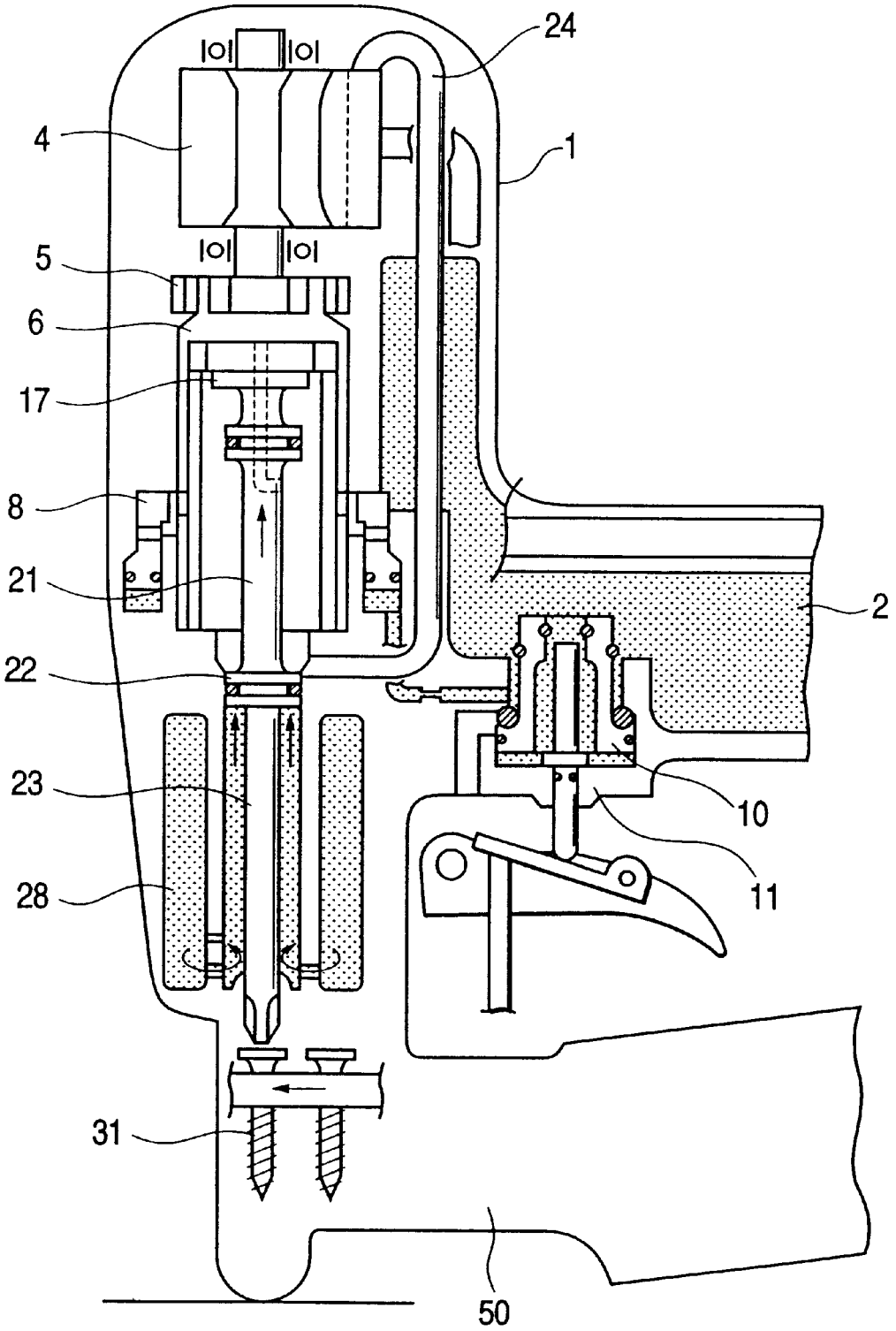
FIG. 7 is a schematic view showing the driver bit which returns to the original position from the condition shown in FIG. 6.

As shown in FIG. 7, when the compressed air is discharged from the upper space of the piston 22, the piston 22 is urged upward by the pressure of the compressed air stored in the returning accumulator chamber 28. Thus, the piston 22 and the driver bit 23 move upward to return their original positions. Then, the screw feeder 50 feeds the next screw 31 in the direction indicated by the arrow. In this manner, one complete cycle of the screw driving operation is accomplished through the above-described sequential first to sixth stages.

As described previously, it takes about 0.1 to 0.2 sec for the screw drivers to accomplish the screw driving operation. This is significantly long compared with 0.005 sec of the nail driving operation by the nail drivers. The operator may release the push lever 110 at an early timing before completing the screw driving operation. According to the conventional screw drivers, such an early release of the push lever 110 will leave the screw 31 incompletely driven in the wood material or the like.

To eliminate this kind of problems caused by the long-time screw driving operation, the present invention provides the orifice 121 in the air passage 12. With the provision of the orifice 121, the flowing speed of the compressed air flowing in the air passage 12 is substantially reduced.

If the orifice 121 is not provided in the air passage 12, the main valve 8 will immediately return to the original position before the driver bit 23 completely drives the screw 31 in the above-described third stage of the screw driving operation. The rotational and protruding movement of the driver bit 23 is thus interrupted incompletely.

However, the provision of the orifice 121 makes it possible to reduce the flowing speed of the compressed air supplied via the air passage 12 to the lower portion of the main valve 8. Thus, the shifting speed of the returning main valve 8 is effectively reduced. This delay time provides a sufficient time for the driver bit 23 to completely finish the driving and fixing operation of the screw 31. Namely, the driver bit 23 can continue rotating and pushing the screw 31 until the screw 31 is fastened completely with its head being flush with the surface of the wood material or the like.

Although the above-described embodiment provides the orifice 121 in the air passage 12 supplying the compressed air from the manual operating valve 11 to the main valve 8, it is possible to provide the orifice 121 in the manual operating valve 11 to reduce the lift speed of the valve piston 10 so that the returning movement of the main valve 8 is delayed.

As apparent from the foregoing description, the driver bit can surely accomplish the driving operation of the screw even when the operator release the push lever at an early timing.

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A pneumatically operable screw driver comprising:

an air motor in which a rotor is rotatable in response to the pressure of compressed air;

a piston rotated by the air motor and driven in an axial direction by the pressure of the compressed air;

a driver bit attached to a front end of said piston;

a manual operating valve having an open position for supplying the compressed air to said air motor and said piston;

a main valve responsive to the closing of said manual operating valve to stop the compressed air supplied to said piston; and a delay mechanism for delaying a shift movement of said main valve when said manual operating valve is closed.

2. The pneumatically operable screw driver in accordance with claim 1, wherein an air passage is provided between said manual operating valve and said main valve, and said delay mechanism is for reducing the flow speed of the compressed air supplied to said main valve via said air passage.

3. The pneumatically operable screw driver in accordance with claim 2, wherein said delay mechanism is an orifice provided in said air passage.

* * * * *